US006471205B2

(12) United States Patent
Lautenklos et al.

(10) Patent No.: US 6,471,205 B2
(45) Date of Patent: Oct. 29, 2002

(54) DEVICE FOR BRAKING SAMPLE AND DEFECTIVE SHEETS OF A SHEET-PROCESSING MACHINE

(75) Inventors: Udo Lautenklos, Wald-Michelbach (DE); Richard Mack, Kennesaw, GA (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/801,208

(22) Filed: Mar. 7, 2001

(65) Prior Publication Data

US 2001/0022426 A1 Sep. 20, 2001

(30) Foreign Application Priority Data

Mar. 7, 2000 (DE) ..... 100 10 971

(51) Int. Cl.[7] ..... B65H 29/68
(52) U.S. Cl. ..... 271/182; 271/274; 271/220
(58) Field of Search ..... 271/220, 207, 271/182, 314, 274, 302

(56) References Cited

U.S. PATENT DOCUMENTS 3,741,536 A * 6/1973 Anderson ..... 271/274
4,163,550 A * 8/1979 Armstrong ..... 271/274
4,824,091 A * 4/1989 Knight ..... 271/207
5,249,791 A 10/1993 Belanger et al.
5,265,861 A 11/1993 Schaffner et al.
5,338,022 A * 8/1994 Funk et al. ..... 271/220
5,499,809 A * 3/1996 Takemoto et al. ..... 271/274
5,661,573 A * 8/1997 Takehara et al. ..... 271/274
6,142,466 A * 11/2000 Dickhoff ..... 271/220

FOREIGN PATENT DOCUMENTS

DE 2 013 137 9/1971
DE 7 219 031 8/1972
DE 39 40 960 A1 7/1991
DE 43 16 051 A1 12/1993
DE 42 35 391 A1 4/1994
JP 0143168 * 6/1988 ..... 271/220

* cited by examiner

*Primary Examiner*—H. Grant Skaggs
(74) *Attorney, Agent, or Firm*—Laurence A. Greenberg; Werner H. Stemer; Ralph E. Locher

(57) ABSTRACT

A device for braking sample and defective sheets of a machine for processing sheet-like printing materials includes a sheet-guiding part for guiding a sheet therealong, a roller resting on the sheet-guiding part and being movable at least in a vertical direction, for braking a sheet guided between the sheet-guiding part and the roller; and a machine for processing sheet-like printing material, such as a printing machine, including the braking device.

14 Claims, 3 Drawing Sheets

DEVICE FOR BRAKING SAMPLE AND DEFECTIVE SHEETS OF A SHEET-PROCESSING MACHINE

BACKGROUND OF THE INVENTION

FIELD OF THE INVENTION

The invention relates to a device for braking sample and defective sheets of a machine for processing flat or sheet-like printing materials, such as a printing machine, wherein a sheet is guided along a sheet-guiding part, and to a machine for processing flat or sheet-like printing materials, in particular, a printing machine, which is equipped with such a device.

Such machines, particularly printing machines, have pile or stacking stations wherein the sheets provided for further use, e.g., for further processing, are deposited. When such a machine is started up, whether for a new printing order or after an interruption in the printing operation, sheets are printed which do not yet have the desired quality and, in this respect, are defective and are referred to as defective sheets or rejects. These must not be deposited in the paper sheet pile or stack provided for further processing, but rather have to be ejected.

Furthermore, during operation of the machine, sample sheets have to be removed regularly, on the one hand, for keeping a running check on the quality of the printed image and, on the other hand, for documenting the quality of the printing within the framework of standards relating to the operating sequence, such as the standard ISO 9000.

For ejecting the sheets, for example, devices have become known heretofore which delay the release of the sheets, conveyed by a chain conveyor and retained on grippers, beyond a normal depositing position of the sheets in a pile or stack provided for further processing, i.e., the grippers open later than in the case of the formation of a sheet pile or stack for acceptable sheets.

After the sheets have been ejected, they have to be braked in order to permit them to be fed to a separate depositing location. Elastic stops which absorb the kinetic energy of the sheets have become known for this purpose. A disadvantage, on the one hand, is that, in the case of such heretofore known known devices, adaptation to different paper grades, such as paper grades of different thicknesses, or different sheet formats is only possible to a limited extent, if at all, and, on the other hand, is that there is a risk of damage to the sensitive sample sheets, in particular, when the kinetic energy of the sample sheet is absorbed exclusively by braking forces acting upon the leading edge of the sheet.

Furthermore known heretofore are brushes which brake the sheets by frictional forces between the bristles and sheets. A risk of the sheet becoming adversely affected exists here as well.

SUMMARY OF THE INVENTION

It is accordingly an object of the invention to provide a straightforward and cost-effective device for braking sample and defective sheets of a machine for processing flat or sheet-like printing materials which avoids the aforementioned disadvantages of the heretofore known devices of this general type.

With the foregoing and other objects in view, there is provided, in accordance with one aspect of the invention, a device for braking sample and defective sheets of a machine for processing sheet-like printing materials, comprising a sheet-guiding part for guiding a sheet therealong, a roller resting on the sheet-guiding part and being movable at least in a vertical direction, for braking a sheet guided between the sheet-guiding part and the roller.

In accordance with another feature of the invention, the roller is disposed upline of at least an approximately vertical stop for the sheet.

In accordance with a further feature of the invention, the roller is formed of soft elastic material.

In accordance with an added feature of the invention, the soft elastic material is rubber.

In accordance with an additional feature of the invention, the roller is preloaded elastically in the direction of the sheet-guiding part.

In accordance with yet another feature of the invention, the roller is equipped for being moved with a horizontal movement component and has an elastic preloading counter to a transporting direction of the sheet.

In accordance with yet a further feature of the invention, the braking device includes a spherically recessed element wherein the roller is mounted, the spherically recessed element, on a side thereof directed away from the roller, being formed with an inclined surface sloping upwardly relative to a transporting direction of the sheet, and being in supporting contact with a stationary guide part for displacement on the inclined surface, the spherically recessed element being preloaded elastically counter to the transporting direction of the sheet.

In accordance with yet an added feature of the invention, the braking device includes a structure for adjusting contact pressure of the roller on the sheet-guiding part.

In accordance with yet an additional feature of the invention, the structure for adjusting contact pressure of the roller on the sheet-guiding part is at least one vertically disposed adjusting screw which is in operational contact with the spherically recessed element via a helical spring.

In accordance with still another feature of the invention, the braking device includes structure for adjusting impact pressure of the roller against the inclined surface by at least one horizontally disposed adjusting screw which is in operational contact with the spherically recessed element via a helical spring.

In accordance with still a further feature of the invention, the adjusting screw is disposed in a threaded bore formed in the sheet-guiding part.

In accordance with still an added feature of the invention, the sheet-guiding part, with the spherically recessed element and the roller, is connected to a swivellable flap which is pivotable about a horizontal axis.

In accordance with still an additional feature of the invention, the adjusting screw for adjusting the contact pressure of the roller on the sheet-guiding part is disposed in a threaded bore formed in the swivellable flap.

In accordance with another aspect of the invention, there is provided a machine for processing sheet-like printing material, including a device for braking sample and defective sheets, comprising a sheet-guiding part for guiding a sheet therealong, a roller resting on the sheet-guiding part and being movable at least in a vertical direction, for braking a sheet guided between the sheet-guiding part and the roller.

In accordance with a concomitant feature of the invention, the machine is constructed as a printing machine. The objects of the invention are thus attained by a device of the general type mentioned in the introduction hereto which has a roller resting on the sheet-guiding part, being movable at least approximately in the vertical direction, and braking a sheet guided between the sheet-guiding part and the roller.

Due to the construction according to the invention of the device for braking sample and defective sheets, those sheets are deposited properly in a position which remains the same, and can easily be removed by hand as required without requiring an operator to be available at each ejection point. A sheet fed to the device according to the invention via the sheet-guiding part comes into contact with the vertically elastically mounted roller via the leading edge thereof, as a result of which the roller is raised, counter to the gravitational force acting upon it, by the thickness of the sheet and can be made to rotate. The sheet is braked slowly by friction between the sheet-guiding part and the roller, with the result that damage to the sheet is avoided.

A preferred embodiment provides that the roller be disposed upline of an at least approximately vertical stop for the sheet. In this case, a sheet guided between the sheet-guiding part and the roller is braked to the extent that damage thereto as it comes into contact with the following stop is reliably avoided. There is thus no need for any damping devices for the last-mentioned stop; however, such devices may be provided optionally. Once the sheet has sprung back from the stop, the roller is made to rotate again in the opposite direction of rotation, and the sheet is brought to a standstill between the sheet-guiding part and the roller. The kinetic energy of the sheet is thus absorbed over a comparatively long distance, and only low braking forces thus act upon the sheet, with the result that damage thereto is avoided.

The device is suitable for different paper grades of different thicknesses, particularly also for cardboards or pasteboards, because the position of the vertically elastically mounted roller is adapted to the thickness of a sheet guided between it and the sheet-guiding part, and the roller always butts against the sheet in order to absorb the kinetic energy thereof. The distance between the roller and the stop is in the order of magnitude of the gripper border of the sheet.

The roller is preferably formed of a soft elastic material, in particular rubber, which simultaneously provides a high coefficient of friction in order to absorb the kinetic energy of the sheet in an effective manner and to prevent the sheet from sliding along the roller without making the roller rotate.

While the roller can be raised solely counter to the weight thereof, a preferred embodiment provides that the roller be prestressed or preloaded elastically in the direction of the sheet-guiding part, in order to increase the braking forces acting upon the sheet and always to provide a desired contact pressure of the sheet in the direction of the sheet-guiding part.

It is further preferably provided that the roller also be able to be moved with a horizontal movement component and prestressed or preloaded elastically counter to the transporting direction of the sheet, with the result that damage to the leading edge of a sheet, in particular of a relatively thick sheet, e.g., a cardboard or pasteboard, as a result of the springing back of the roller as the sheet comes into contact with the roller is reliably avoided.

The roller is preferably mounted in a spherically recessed or indented element which, on a side thereof directed away from the roller, has an inclined surface sloping upwardly relative to the transporting direction of the sheet, and is in supporting contact with a stationary guiding part so that it is displaceable on the inclined surface, the spherically recessed element being prestressed or preloaded elastically counter to the transporting direction of the sheet. This forms, between the guide part and the spherically recessed element, a slide bearing which ensures longitudinal displaceability of the roller in order that, in particular, the leading edge of sheets of different thicknesses is not damaged and the sheets are simultaneously braked as they come into contact with the roller, in that the roller, which is prestressed elastically counter to the transporting direction of the sheet, is moved along the inclined surface in the direction of the sheet until the distance between the roller and the sheet-guiding part corresponds at least to the thickness of the sheet. When the sheet springs back from the stop, longitudinal displacement of the roller in the rearward direction beyond a point at which the distance between the roller and the sheet-guiding part corresponds to the thickness of the sheet is prevented by the slide bearing formed between the sheet-guiding part and the spherically recessed element, and the sheet is brought to a standstill by the roller.

In order to adapt the device according to the invention to different paper grades, and to adjust the desired removal position of each sheet brought to a standstill by the roller, it is preferably possible to adjust the contact pressure of the roller on the sheet-guiding part. It is possible to adjust the contact pressure of the roller, for example, by at least one vertically arranged adjusting screw, which is in supporting contact with the spherically recessed element via a helical spring and thus prestresses the roller with a variable force in the direction of the sheet-guiding part. It is also preferably possible to adjust the impact pressure of the roller against the slope by at least one horizontally arranged adjusting screw, which is in supporting contact with the spherically recessed element via a helical spring, and is disposed, for example, in a threaded bore formed in the sheet-guiding part.

One embodiment provides that the sheet guiding part, with the spherically recessed element and the roller, is connected to a swivellable flap which can be pivoted about a horizontal axis, in which case the device is in the operating position when the swivellable flap is closed, and the ejected sheet can be removed once the swivellable flap has been opened. In such a configuration, the adjusting screw, for adjusting the contact pressure of the roller on the sheet-guiding part, is preferably arranged in a threaded bore of the swivellable flap, in order to set the contact pressure of the roller on the sheet-guiding part in the operating position of the device according to the invention, with the swivellable flap closed.

The invention also relates to a machine which processes sheet-like printing materials and is equipped with a braking device of the aforementioned type.

Other features which are considered as characteristic for the invention are set forth in the appended claims.

Although the invention is illustrated and described herein as embodied in a device for braking sample and defective sheets of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
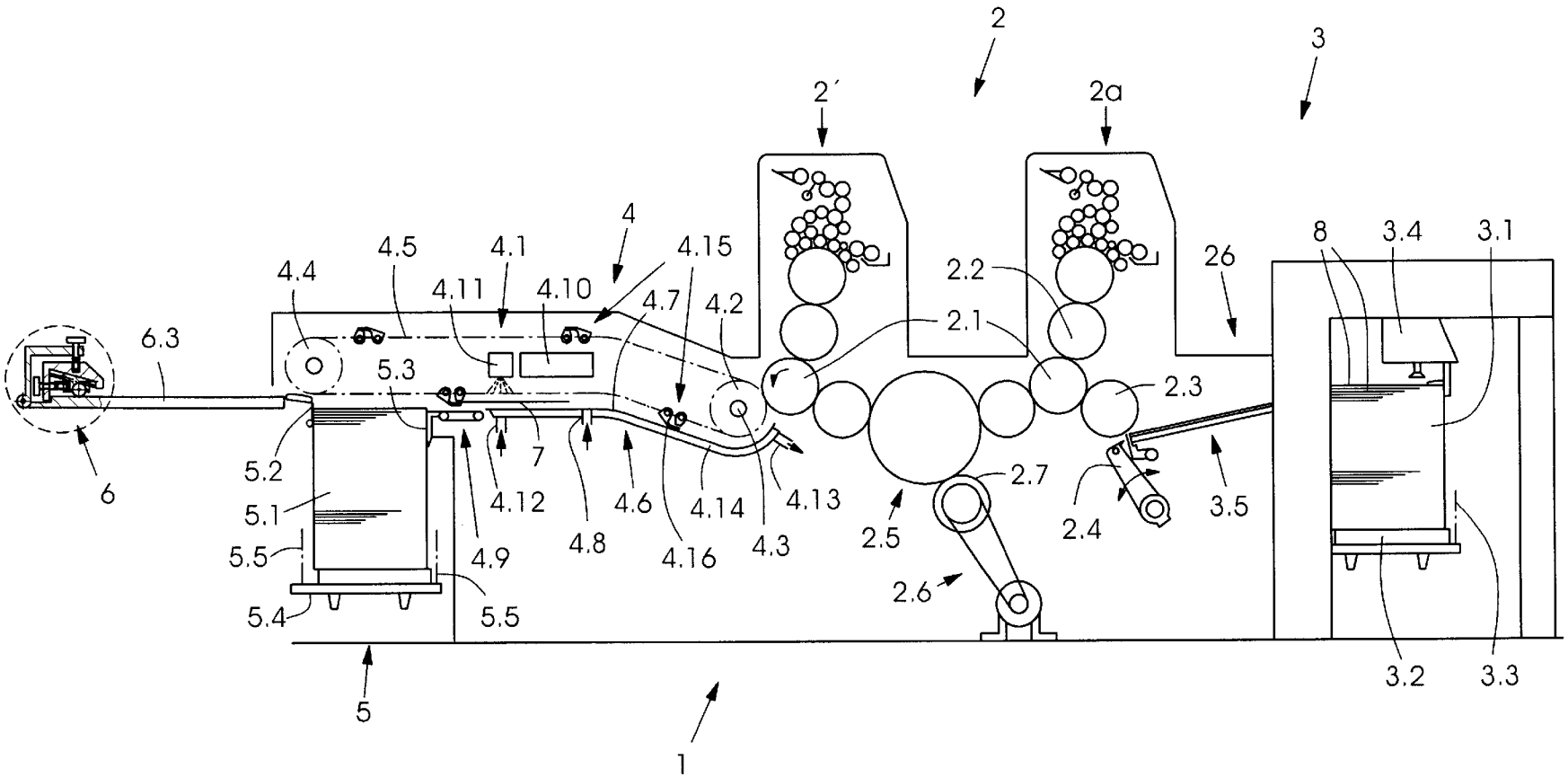
FIG. 1 is an overall diagrammatic side elevational view of an embodiment of a machine for processing flat or sheet-like printing materials in the form of an offset printing machine, the device according to the invention for braking sample and defective sheets being illustrated on an enlarged scale relative to the machine as a whole in a broken-line circle at the extreme lefthand side of the figure.

Referring now to the drawings and, first, particularly to FIG. 1 thereof, there is shown therein an overall diagrammatic view of a machine 1 for processing flat or sheet-like printing materials. The machine 1 has a printing machine 2, a sheet-feeding device 3 which is arranged at an inlet side of the printing machine 2 and is in the form of a feeder, a delivery 4 which is arranged at an outlet side of the printing machine 2 and has a chain conveyor 4.1, a sheet pile or stacking station 5 arranged beneath an end region of the chain conveyor 4.1 and, following the pile or stacking station 5, a device 6 for accommodating and aligning sample and defective sheets, the device 6 being illustrated partly in section here, on an enlarged scale for reasons of clarity, within a broken-line circle.

The sheet-feeding device 3 has an exchangeable pile or stack base 3.2 bearing a pile or stack 3.1 formed of sheets 8, the base 3.2 being, for example, in the form of a pallet. In order to raise the pile or stack base 3.2 in a stepwise manner as sheets 8 are withdrawn from the pile or stack 3.1, a lifting mechanism which operates with lifting chains 3.3 shown in phantom is provided. Disposed above the pile or stack 3.1 is a separating or singling unit 3.4 with lifting and forwarding or pull suckers for gripping the respectively uppermost sheet 8 of the pile or stack 3.1 and for transferring that sheet 8 to a transporting and aligning unit 3.5, which includes a suction-belt conveyor, and aligns the sheets 8 at the leading edge and a lateral edge thereof in order to pass the sheets onward.

The printing machine 2, which, in this case, is a rotary printing machine, has two printing units 2*a* and 2' in the illustrated exemplary embodiment. It is thus constructed for printing in two colors. For printing in further colors, a further printing unit has to be provided for each additional color.

The printing unit 2*a* has an impression cylinder 2.1 and a blanket cylinder 2.2, which cooperates with the impression cylinder 2.1, and a feeding drum 2.3 which transfers to the impression cylinder 2.1 the sheet which is to be printed in the respective printing unit. The printing unit 2' is provided with corresponding equipment.

Arranged between the transporting unit 3.5 and the feeding drum 2.3 is a pregripper 2.4 which receives a sheet 8, supplied and aligned by the transporting and aligning unit 3.5, and transfers it to the feeding drum 2.3, which then transfers it to the impression cylinder 2.1 of the first printing unit 2*a*.

A sheet-transfer device 2.5 is provided between the printing units 2*a* and 2'. If two printing units connected by such a sheet-transfer device print the same side of a sheet with different colors, the sheets are transferred by the sheet-transfer device without being turned or reversed; if two printing units connected by such a sheet-transfer device, respectively, print a different side of a sheet, the corresponding sheet-transfer device is constructed so that the sheets are transferred turned or reversed from the one printing unit to the following printing unit.

Provided for operation is a drive 2.6 with a belt drive mechanism driven by a motor, the belt drive mechanism driving a drive gearwheel 2.7 which is in meshing engagement with a gearwheel of the sheet-transfer device 2.5. In the embodiment of FIG. 1, the chain conveyor 4.1 and the paper sheet-feeding device 3 are also operatively connected with the drive 2.6 via corresponding gearwheels so that when the printing units 2*a* and 2' are at a standstill, the other components involved in feeding sheets to the printing machine and with the delivery of sheets therefrom, respectively, are brought to a standstill.

In the delivery 4, the printed sheets are transferred to the chain conveyor 4.1, which is in operative connection with the drive 2.6.

The chain conveyor 4.1 includes two conveying chains 4.5, of which, each revolves along a respective side wall of the delivery 4. A respective conveying chain 4.5 is looped around one of two drive sprocket wheels 4.2, which rotate synchronously during operation and of which the axes of rotation are aligned with one another and, in the exemplary embodiment of FIG. 1, is guided over a respective deflecting or reversing sprocket wheel 4.4 which is located downline of the drive sprocket wheels 4.2, as viewed in the processing direction. The drive sprocket wheels 4.2 are incorporated in a gear train of the printing machine, which is driven by the drive 2.6. In the exemplary embodiment of FIG. 1, the drive sprocket wheels 4.2 are seated on a common sprocket-wheel shaft 4.3. Extending between the two conveying chains 4.5 are gripper systems 4.15, borne by the conveying chains, and provided with grippers 4.16, which pass through gaps between grippers disposed on the impression cylinder 2.1 and, simultaneously, receive a sheet 8 from the latter grippers by gripping a gripper border at the leading end of the sheet 8 immediately before the grippers disposed on the impression cylinder 2.1 are opened. In the exemplary embodiment of FIG. 1, the sheets 8 are transported by the lower chain. strands shown in FIG. 1. That section of the chain path through which the chain strands pass is followed alongside by a sheet-guiding surface 4.7 which faces towards the chain path and is formed on a sheet-guiding unit 4.6. A carrying air cushion is preferably formed between the sheet-guiding surface and the sheet 8, respectively, guided thereabove. For this purpose, the sheet-guiding unit 4.6 is equipped with blast or blowing-air nozzles 4.8 which open out into the sheet-guiding surface 4.7, only one of the nozzles 4.8 being illustrated in FIG. 1 as a symbolic representative for all thereof.

In order to prevent the printed sheets 8 from sticking together once they have been deposited in a pile or stack, a dryer 4.10 and a powder sprayer 4.11 are provided on the path of the sheets 8 from the drive sprocket wheels 4.2 to a sheet brake 4.9. In order to avoid excess heating of the sheet-guiding surface 4.7, a coolant circuit is integrated in the sheet-guiding unit 4.6 and is represented symbolically in FIG. 1 by an inlet nozzle 4.12 and an outlet nozzle 4.13 on a coolant tray 4.14 arranged on the sheet-guiding surface 4.7. The sheet brake 4.9 includes a plurality of braking modules, which in this case are each formed by a suction-belt conveyor.

From the chain conveyor 4.1, the sheets 8 are transferred into the pile or stacking station 5, with the result that a pile or stack 5.1 of sheets forms therein. The pile or stacking station 5 has, in a top region thereof for accommodating the sheets, a leading-edge stop 5.2 and a trailing-edge stop 5.3 located opposite thereto, the sheets being aligned by the stops 5.2 and 5.3. The pile or stacking station 5 also has a lifting mechanism, of which FIG. 1 illustrates only a platform 5.4, which bears the pile or stack 5.1, and lifting chains 5.5 shown in phantom, which bear the platform 5.4.

The pile or stacking station 5 is followed by an otherwise non-illustrated device for ejecting sample and defective sheets and by a device 6 according to the invention for braking the sample and defective sheets, which is described in detail hereinbelow.

The sheet-processing machine 1 operates as follows:

A sheet 8 which is to be processed is removed from the pile or stack 3.1 by the separating or singling unit 3.4 and transferred to the transporting unit 3.5. As has been mentioned hereinbefore, the latter transfers the sheet to the pregripper 2.4, which transfers it, in turn, to the feeding drum 2.3. The sheet is then passed through the printing units 2*a* and 2', via the impression cylinders 2.1 and the sheet-transfer device 2.5, and printed in the process.

The sheet 8 is transferred from the last impression cylinder 2.1 to a gripper system 4.15 belonging to the chain conveyor 4.1 and passing the last impression cylinder 2.1. In order to deposit the sheet 8 on the pile or stack 5.1, the grippers 4.16 open for transferring the sheet 8 to the sheet brake 4.9, when a trailing section of the sheet 8 is located above the sheet brake 4.9. The sheet brake imparts to the sheet 8 a depositing speed which is lower than the processing speed and releases the sheet 8 after it has reached the depositing speed, with the result that a correspondingly retarded sheet 8 finally comes into contact, in the pile or stacking station 5, with the leading-edge stops 5.2 and, after being aligned with the latter and with the trailing-edge stops 5.3, which are located opposite the leading-edge stops, forms the pile or stack 5.1 together with preceding and/or following sheets, the pile or stack 5.1 being lowered as it grows.

Should sample or defective sheets, the latter being referred to as so-called rejects, be ejected rather than deposited in the pile or stack 5.1, then, for example, manual actuation by an operator prevents the sheet-bearing grippers 4.16 from opening above the pile or stack 5.1 and causes the grippers 4.16 to be opened only in the region of the end of the bottom strand of the conveying chain 4.5. At the same time, the suction operation of the brake 4.9 is preferably interrupted.

Provision may be made for basically initially ejecting all of the first sheets as rejects, when the machine is started up, until the desired quality has been achieved. Manual operation by the operator can then cause following sheets to be deposited on the pile or stack 5.1. Automatic ejection of sheets 8 during operation can take place so that, after a predetermined number of sheets have been deposited in the pile or stack 5.1, one sheet 8, respectively, is ejected as a sample sheet and for documentation purposes, for example, for quality assurance in accordance with standard ISO 9000.

Figure 2:
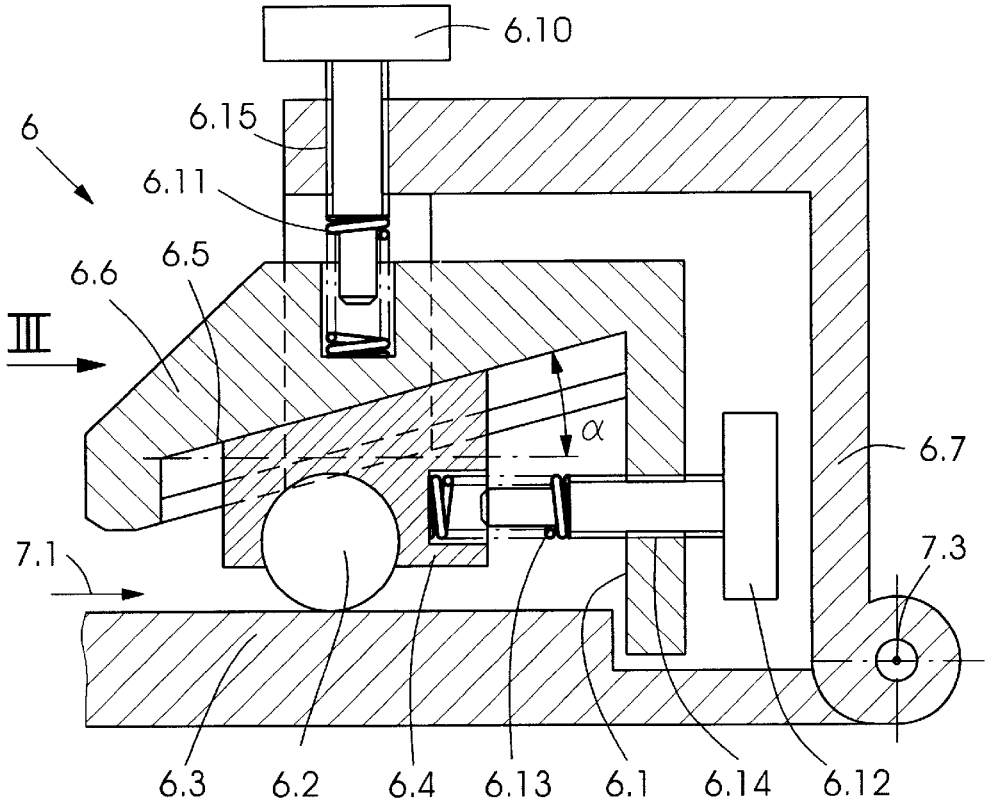
FIG. 2 is a diagrammatic vertical sectional view, taken in the travel direction of ejected sheets, through an embodiment of the device according to the invention for braking sample and defective sheets.
Figure 3:
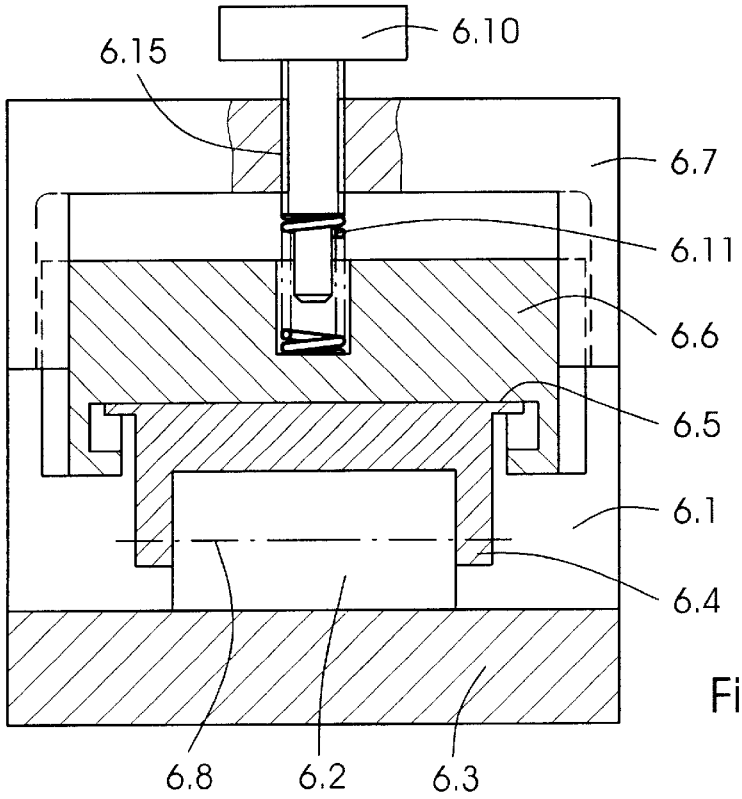
FIG. 3 is a diagrammatic view, partly in section, of FIG. 2, taken in the direction of arrow III.

The device 6 for braking sample and defective sheets, which is illustrated in FIGS. 2 and 3, has a vertical stop 6.1 for a respective sheet 8, and a roller 6.2, which is disposed upline of the stop 6.1 and has a longitudinal axis 6.8, is seated on a sheet-guiding part 6.3 and serves for gripping the sheet between the sheet-guiding part 6.3 and the roller 6.2, with the sheet being braked in the direction of the stop 6.1, and for holding the sheet after it springs back from the stop 6.1.

The roller 6.2 is preferably formed of an elastic material, such as rubber, particularly, providing a high coefficient of friction.

The roller 6.2 is preloaded in the direction of the sheet-guiding part 6.3 and counter to the transporting direction 7.1 of the sheet and is enclosed, over more than 180° of the circumference thereof, by a calotte or spherically recessed element 6.4 which, on a side thereof directed away from the roller 6.2, is formed with an inclined surface 6.5, upwardly sloping relative to the transporting direction 7.1 of the sheet, and is in supporting contact with a stationary guide part 6.6 so that it is displaceable on the inclined surface 6.5. The angle of inclination $\alpha$ of the inclined surface 6.5 is, for example, between 10 ° and 30° , and in the illustrated embodiment approximately 20°. It is possible to adjust the contact pressure of the roller 6.2 on the sheet-guiding part 6.3 via a vertically extending adjusting screw 6.10, which is in operative contact with the spherically recessed element 6.4 through the intermediary of a helical spring 6.11. Correspondingly, it is possible to adjust the impact pressure of the roller 6.2 on the slope 6.5 by an adjusting screw 6.12, which is disposed in a threaded bore 6.14 of the guide part 6.6 and is in operative connection with the spherically recessed element 6.4 via a helical spring 6.13. In this way, the device 6 according to the invention is suitable for sheets of different thicknesses, assurance being provided that the kinetic energy of the fed sheets is absorbed without any adverse effect, and damage to the sheets thereby being avoided. The sheets braked between the roller 6.2 and sheet-guiding part 6.3 come to a standstill in a removal position which remains the same.

The device 6 also has a swivellable flap 6.7 which is pivotable about a horizontal axis 7.3 and is connected to the guide part 6.6, with the spherically recessed element 6.4 and the roller 6.2. In FIGS. 2 and 3, the device 6 is in an operating position thereof; the swivellable flap 6.7 is closed and locked by an otherwise non-illustrated arresting device. The adjusting screw 6.10 for adjusting the contact pressure of the roller 6.2 on the sheet-guiding part 6.3 is disposed in a threaded bore 6.15 of the swivellable flap 6.7, with the result that it is possible to adjust the contact pressure of the roller 6.2 during operation with the swivellable flap 6.7 closed. In order to remove a sheet from the device 6, the swivellable flap 6.7, with the guide part 6.6, the spherically recessed element 6.4 and the roller 6.2, can be pivoted upwardly about the axis 7.3 after a corresponding unlocking operation, with the result that it is possible to remove a sheet located between the roller 6.2 and the sheet-guiding part 6.3.

FIGS. 4 to 7 are diagrammatic views of the roller 6.2, mounted in the spherically recessed element 6.4, in different operating situations or phases of the device according to the invention.

Figure 4:
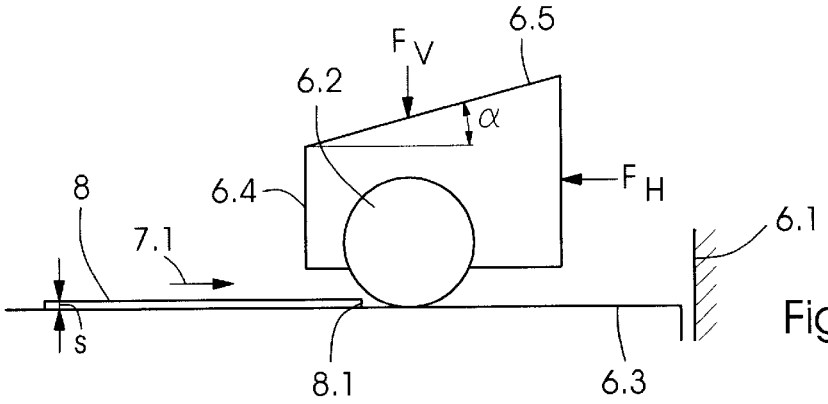
FIGS. 4 to 7 are diagrammatic views of functional elements of the device according to the invention for the purpose of illustrating the functional principle thereof in different operational situations.
Figure 5:
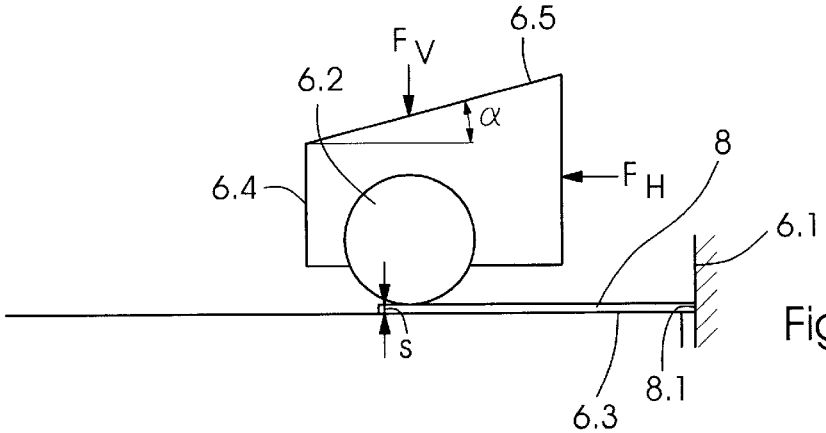
Figure 6:
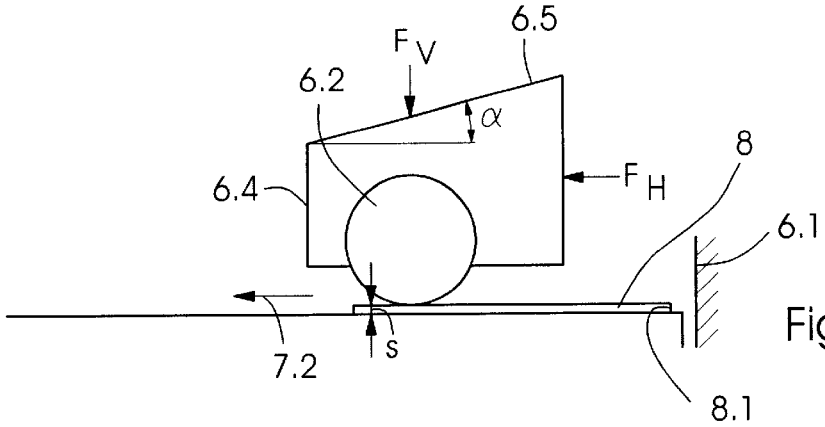

In the operating situation shown in FIG. 4, an ejected sheet 8 is approaching the roller 6.2 in the transporting direction 7.1. The roller 6.2 is at rest. At the instant of time at which the leading end 8.1 of the sheet 8 comes into contact with the roller 6.2, the latter is raised, counter to a vertical preloading or prestressing Fv, in accordance with the thickness s of the sheet 8 and as a result, in accordance with the thickness of the sheet 8, is displaced, counter to a horizontal preloading or prestressing $F_H$, along the slope 6.5 in the transporting direction 7.1 of the sheet 8. The roller 6.2 is caused to rotate by the sheet 8 and, with braking of the sheet, is guided in the direction of the stop 6.1.

At the instant of time at which the leading end 8.1 of the sheet 8 reaches the stop 6.1 (note FIG. 5), the sheet 8 springs back in the direction 7.2, which is counter to the transporting direction 7.1 (note FIG. 6), and the roller 6.2 is thus caused to rotate in the opposite direction.

Figure 7:
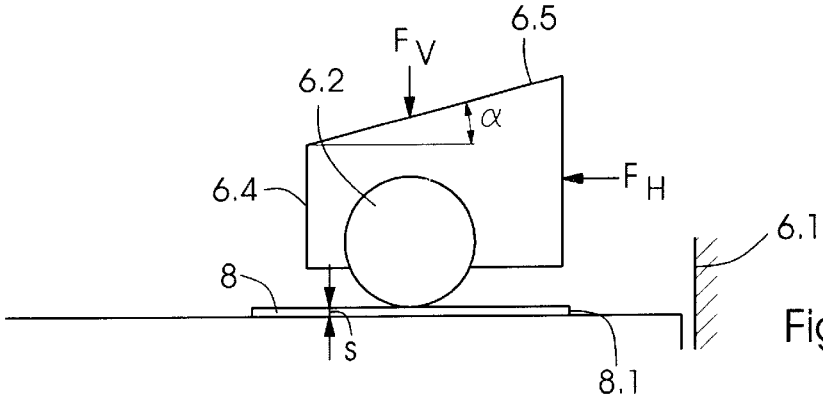

Once the kinetic energy of the sheet 8 has been fully absorbed, the sheet is located, for example, in the position illustrated in FIG. 7 and can be removed by raising the roller 6.2 (e.g., by pivoting away the swivellable flap illustrated in FIGS. 2 and 3).

The frictional forces between the sheet 8 and the roller 6.2 which are necessary for absorbing the kinetic energy of the sheet are adjustable by varying the prestressing or preloading $F_V$ and $F_H$. By selecting the angle $\alpha$, it is also possible to adjust the longitudinal displacement of the roller 6.2 induced by the thickness s of the respective sheet 8, and thus likewise the desired braking action of the roller 6.2.

We claim:

1. A device for braking sample and defective sheets of a machine for processing sheet-like printing materials, comprising:

a sheet-guiding part for guiding a sheet therealong; and a roller resting on said sheet-guiding part for braking the sheet guided between said sheet-guiding part and said roller, said roller being movable in a vertical direction, being equipped for being moved with a horizontal movement component and having an elastic preloading counter to a transporting direction of the sheet.

2. The braking device according to claim 1, wherein said roller is disposed upline of at least an approximately vertical stop for the sheet.

3. The braking device according to claim 1, wherein said roller is formed of soft elastic material.

4. The braking device according to claim 3, wherein said soft elastic material is rubber.

5. The braking device according to claim 1, wherein said roller is preloaded elastically in the direction of said sheet-guiding part.

6. A device for braking sample and defective sheets of a machine for processing sheet-like printing materials, comprising:

a sheet-guiding part for guiding a sheet therealong;

a roller resting on said sheet-guiding part for braking the sheet guided between said sheet-guiding part and said roller; and a spherically recessed element, said roller being mounted in said spherically recessed element, said spherically recessed element, on a side thereof directed away from said roller, being formed with an inclined surface sloping upwardly relative to a transporting direction of the sheet, and being in supporting contact with a stationary guide part for displacement on said inclined surface, said spherically recessed element being preloaded elastically counter to said transporting direction of the sheet.

7. The braking device according to claim 6, including a structure for adjusting contact pressure of said roller on said sheet-guiding part.

8. The braking device according to claim 7, wherein said structure for adjusting contact pressure of said roller on said sheet-guiding part is at least one vertically disposed adjusting screw which is in operational contact with said spherically recessed element via a helical spring.

9. The braking device according to claim 8, wherein said sheet-guiding part, with said spherically recessed element and said roller, is connected to a swivellable flap which is pivotable about a horizontal axis.

10. The braking device according to claim 9, wherein said adjusting screw for adjusting the contact pressure of said roller on said sheet-guiding part is disposed in a threaded bore formed in said swivelled flap.

11. The braking device according to claim 6, including structure for adjusting impact pressure of said roller against said inclined surface by at least one horizontally disposed adjusting screw which is in operational contact with said spherically recessed element via a helical spring.

12. The braking device according to claim 11, wherein said adjusting screw is disposed in a threaded bore formed in said sheet-guiding part.

13. A machine for processing sheet-like printing materials, including a device for braking sample and defective sheets, comprising;

a sheet-guiding part for guiding a sheet therealong; and a roller resting on said sheet-guiding part for braking the sheet guided between said sheet-guiding part and said roller, said roller being movable in a vertical direction, being equipped for being moved with a horizontal movement component and having an elastic preloading counter to transporting direction of the sheet.

14. The machine according to claim 13, wherein the machine is constructed as a printing machine.

* * * * *